US007429151B2

(12) United States Patent
Hessman

(10) Patent No.: US 7,429,151 B2
(45) Date of Patent: Sep. 30, 2008

(54) COATED INSERTS FOR WET MILLING

(75) Inventor: Ingemar Hessman, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 267 days.

(21) Appl. No.: 11/261,909

(22) Filed: Oct. 31, 2005

(65) Prior Publication Data

US 2006/0110532 A1 May 25, 2006

(30) Foreign Application Priority Data

Nov. 8, 2004 (SE) ..... 0402708
Jan. 3, 2005 (SE) ..... 0500015

(51) Int. Cl.
*B32B 9/00* (2006.01)
*C23C 16/30* (2006.01)

(52) U.S. Cl. ..... 407/119; 76/44; 51/307; 51/309; 427/249.19; 427/255.391; 427/368; 427/419.2; 427/419.7; 428/156; 428/176; 428/216; 428/325; 428/698; 428/701; 428/702

(58) Field of Classification Search ..... 428/699, 428/698, 701, 702, 325, 216, 336, 472, 156, 428/174; 51/307, 309; 76/44; 407/119; 427/249.17, 249.19, 255.28, 255.29, 255.391, 427/368, 419.1, 419.2, 419.7
See application file for complete search history.

(56) References Cited

U.S. PATENT DOCUMENTS

| | | | | |
|---|---|---|---|---|
| 5,674,564 | A | 10/1997 | Ljungberg et al. | |
| 5,861,210 | A | 1/1999 | Lenander et al. | |
| 5,945,207 | A | 8/1999 | Kutscher et al. | 428/216 |
| 5,976,707 | A * | 11/1999 | Grab | 428/698 |
| 6,221,479 | B1 * | 4/2001 | Waldenstrom et al. | 428/698 |
| 6,406,224 | B1 | 6/2002 | Ostlund et al. | 407/119 |
| 6,638,609 | B2 | 10/2003 | Nordgren et al. | 428/216 |

* cited by examiner

*Primary Examiner*—Archene Turner
(74) *Attorney, Agent, or Firm*—Drinker Biddle & Reath LLP

(57) ABSTRACT

Coated milling inserts particularly useful for milling of highly alloyed grey cast iron with or without cast skin under wet conditions at preferably rather high cutting speeds and milling of nodular cast iron and compacted graphite iron with or without cast skin under wet conditions at moderate cutting speeds are disclosed.

The inserts are characterised by a WC—Co cemented carbide with a low content of cubic carbides and a highly W-alloyed binder phase and a coating including an inner layer of $TiC_xN_y$ with columnar grains followed by a layer of κ-$Al_2O_3$ and a top layer of TiN.

20 Claims, No Drawings

COATED INSERTS FOR WET MILLING

BACKGROUND OF THE INVENTION

The present invention relates to coated cemented carbide cutting tool inserts, particularly useful for rough milling under wet conditions of highly alloyed grey cast iron with or without cast skin, at preferably rather high cutting speeds but also of nodular cast iron and compacted graphite iron with or without cast skin at moderate cutting speeds. The microgeometry is balanced with the substrate and coating to meet the loads from the machining application.

U.S. Pat. No. 5,945,207 discloses a coated cutting insert particularly useful for cutting in cast iron materials. The insert is characterized by a straight WC—Co cemented carbide body having a highly W-alloyed Co binder phase, a well-defined surface content of Co and a coating including an innermost layer of $TiC_xN_yO_z$ with columnar grains, a layer of a fine-grained, textured $Al_2O_3$ and a top layer of $TiC_xN_yO_z$ that has been removed along the cutting edge line.

U.S. Pat. No. 6,638,609 discloses coated milling inserts particularly useful for milling of grey cast iron with or without cast skin under wet conditions at low and moderate cutting speeds and milling of nodular cast iron and compacted graphite iron with or without cast skin under wet conditions at moderate cutting speeds. The inserts are characterised by a WC—Co cemented carbide with a low content of cubic carbides and a highly W-alloyed binder phase and a coating including an inner layer of $TiC_xN_y$ with columnar grains followed by a layer of κ-$Al_2O_3$ and a top layer of TiN.

SUMMARY OF THE INVENTION

It is an object of the present invention to provide coated cemented carbide cutting tool inserts, particularly useful for milling of alloyed grey cast with or without cast skin under wet conditions, at preferably rather high cutting speeds but also for milling of nodular cast iron and compacted graphite iron with or without cast skin under wet conditions at rather high cutting speeds.

In one aspect of the invention, there is provided a cutting tool insert comprising a cemented carbide body and a coating wherein said cemented carbide body comprising WC with an average grain size of from about 1 to about 2.5 μm, from about 5 to about 8 wt-% Co and less than about 0.5 wt % cubic carbides of the metals Ta, Ti and/or Nb and a highly W-alloyed binder phase with a CW-ratio of 0.75-0.93 with less than about 1 vol-% eta-phase, and said coating comprising a first, innermost layer of $TiC_xN_yO_z$ with x+y+z=1, y>x and z less than abut 0. 2 with equiaxed grains with size less than about 0.5 μm and a total thickness of from about 0.1 to about 1.5 μm, a layer of $TiC_xN_y$ with x+y=1, x greater than about 0.3 and y greater than about 0.3 with a thickness of from about 2 to about 3 μm with columnar grains with an average diameter of less than about 5 μm, a layer of a smooth, fine-grained, to from about 0.5 to about 2 μm average grain size κ-$Al_2O_3$ with a thickness of from about 1 to about 2.5 μm and an outer layer of TiN with a thickness of from about 0.5 to about 1.0 μm.

In another aspect of the invention, there is provided a method of making a milling insert comprising a cemented carbide body and a coating, said cemented carbide body comprising of WC with an average grain size of from about 1 to about 2.5 μm, from about 5 to about 8 wt-% Co and less than about 0.5 wt % cubiccarbides of the metals Ta, Ti and/or Nb and a highly W-alloyed binder phase with a CW-ratio of 0.75-0.93 with <1 vol-% eta-phase the method comprising the steps of:

depositing by a CVD-method a first, innermost layer of $TiC_xN_yO_z$ with x+y+z=1, y>x and z less than about 0.2 having an equiaxed grain structure with a size less than about 0.5 μm and a total thickness of from about 0.1 to about 1.5 μm, depositing by a MTCVD-technique a layer of $TiC_xN_y$ with x+y=1, x greater than about 0.3 and y greater than about 0.3 with a thickness of from about 1 to about 4 μm having a columnar grain structure with an average diameter of less than about 5 μm, wherein the MTCVD-technique uses acetonitrile as a source of carbon and nitrogen for forming a layer in a temperature range of from about 700 to about 900° C., depositing a layer of a smooth κ-$Al_2O_3$ with a thickness of from about 1 to about 2.5 μm and depositing an outer layer of TiN with a thickness of from about 0.5 to about 1.0 μm.

DETAILED DESCRIPTION OF THE INVENTION

It has now surprisingly been found that by combining many different features cutting tool inserts, preferably for milling, can be obtained with excellent cutting performance when milling grey cast iron with or without cast skin using fluid coolant at preferably rather high cutting speeds as well as in milling of nodular and compacted graphite iron using fluid coolant at preferably moderate cutting speeds, in iron castings with or without cast skin.

The cutting tool inserts according to the present invention show improved properties with respect to the different wear types prevailing at the above mentioned cutting conditions.

The cutting tool inserts according to the present invention comprise a cemented carbide body with a relatively high W-alloyed binder phase and with a well balanced chemical composition and grain size of the WC, a columnar $TiC_xN_y$-layer, a κ-$Al_2O_3$-layer, a TiN-layer and optionally with smoothed cutting edges.

According to the present invention, a cutting tool insert is provided with a cemented carbide body of a composition of from about 5 to about 8 wt-% Co, preferably from about 5 to about 7 wt-% Co, less than about 0.5 wt-%, preferably 0 wt-%, cubic carbides of the metals Ti, Ta and/or Nb and balance WC. The average grain size of the WC is in the range of from about 1 to about 2.5 μm. The cobalt binder phase is highly alloyed with W. The content of W in the binder phase can be expressed as the $$\text{CW-ratio}=M_s/(\text{wt-\% Co}\cdot 0.0161),$$

where $M_s$ is the measured saturation magnetization of the cemented carbide body in $hAm^2/kg$ and wt-% Co is the weight percentage of Co in the cemented carbide. The CW-value is a function of the W content in the Co binder phase. A low CW-value corresponds to a high W- content in the binder phase.

According to the present invention, improved cutting performance is achieved if the cemented carbide body has a CW-ratio of 0.75-0.93, preferably 0.80-0.90. The cemented carbide body may contain small amounts, less than about 1 volume-%, of eta phase ($M_6C$), without any detrimental effect.

Preferably, the surface composition of the cemented carbide insert is well defined and the amount of Co on the surface is within about −2 wt % to about +4 wt % of the nominal content.

The uncoated cutting edge has a radius of from about 35 to about 60 μm, preferably about to from about 45 to about 55 μm.

The coating comprises:

a first (innermost) layer of $TiC_xN_yO_z$ with x+y+z=1, y>x and z less than about 0.2, preferably y greater than about 0.8 and z=0, with equiaxed grains with size less than about 0.5 μm and a total thickness less than about 1.5 μm, preferably greater than about 0.1 μm, a layer of $TiC_xN_y$ with x+y=1, x greater than about 0.3 and y greater than about 0.3, preferably x greater than or equal to about 0.5, with a thickness of from about 2 to about 3 μm with columnar grains and with an average diameter of less than about 5 μm, preferably from about 0.1 to about 2 μm, a layer of a smooth, fine-grained (average grain size from about 0.5 to about 2 μm) $Al_2O_3$ consisting essentially of the K-phase. However, the layer may contain small amounts (less than about 5 vol-%) of other phases such as θ- or α-phase as determined by XRD-measurement. The $Al_2O_3$-layer has a thickness of from about 1 to about 2 μm, preferably from about 1.2 to about 1.7 μm and a further from about 0.1 to about 1.0 μm thick layer of TiN. This outermost layer of TiN has a surface roughness $R_{max} \leqq 0.4$ μm over a length of 10 μm at least on the active part of the cutting edge. The TiN-layer is preferably removed along the cutting edge and the underlying alumina layer may be partly or completely removed along the cutting edge.

The present invention also relates to a method of making a coated cemented carbide body of a composition 5-8, preferably from about 5 to about 7, wt-% Co, less than about 0.5 wt-%, preferably 0 wt-%, cubic carbides of the metals Ti, Ta and/or Nb and balance WC. The average grain size of the WC is in the range of from about 1 to about 2.5 μm. The cobalt binder phase is highly alloyed with W. The content of W in the binder phase expressed as CW-ratio is 0.75-0.93, preferably 0.80-0.90.

The uncoated cutting edge is provided with an edge radius of from about 35 to about 60 μm, preferably from about 45 to about 55 μm.

The coating comprises:

a first (innermost) layer of $TiC_xN_yO_z$ with x+y+z=1, y>x and z less than about 0.2, preferably y greater than about 0.8 and z=0, with equiaxed grains with size less than abut 0.5 μm and a total thickness less than about 1.5 μm, preferably greater than about 0.1 μm, using known CVD-methods, a layer of $TiC_xN_y$ with x+y=1, x greater than about 0.3 and y greater than about 0.3, preferably x greater than or equal to abut 0.5, with a thickness of from about 1 to about 3 μm, preferably of from about 2 to abut 2.7 μm, with columnar grains and with an average diameter of less than about 5 μm, preferably of from about 0.1 to about 2 μm using preferably MTCVD-technique (using acetonitrile as the carbon and nitrogen source for forming the layer in the temperature range of from about 700 to about 900° C.). The exact conditions, however, depend to a certain extent on the design of the equipment used, a smooth $Al_2O_3$-layer consisting essentially of κ-$Al_2O_3$ is deposited under conditions disclosed in e.g. U.S. Pat. No. 5,674,564 herein incorporated by reference in its entirety. The $Al_2O_3$ layer has a thickness of from about 0.5 to about 2.5 μm, preferably of from about 1 to about 2 μm and a from about 0.5 to about 1.0 μm thick layer of TiN with a surface roughness $R_{max} \leqq 0.4$ μm over a length of 10 μm at least on the active part of the cutting edge.

The smooth coating surface is obtained by a gentle wet-blasting of the coating surface with fine grained (from about 400 to about 150 mesh) alumina powder or by brushing the edges with brushes based on, e.g., SiC as disclosed e.g. in U.S. Pat. No. 5,861,210. The TiN-layer is preferably removed along the cutting edge and the underlying alumina layer may be partly or completely removed along the cutting edge.

The invention also relates to the use of cutting tool inserts according to above for wet milling, using fluid coolant, of alloyed grey cast iron, at of from about 110 to about 270 m/min and a feed of from about 0.15 to about 0.35 mm/tooth. It also relates to the use of cutting tool inserts according to above for wet milling of compacted graphite iron and nodular iron at a cutting speed of from about 70 to about 230 m/min and a feed of from about 0.15 to about 0.35 mm/tooth depending on cutting speed and insert geometry.

The invention is additionally illustrated in connection with the following examples, which are to be considered as illustrative of the present invention. It should be understood, however, that the invention is not limited to the specific details of the examples.

EXAMPLE 1

Cemented carbide milling inserts in accordance with the invention with the composition 6.0 wt-% Co and balance WC were sintered in a conventional way at 1410° C. and cooled down to 1200° C. in 0.6 bar $H_2$ giving inserts with a binder phase alloyed with W, corresponding to a CW-ratio of 0.9. The average WC grain size was 1.3 μm. After conventional ER-treating to an edge radius of 50 μm, the inserts were coated with a 0.5 μm equiaxed $TiCO_{0.05}N_{0.95}$-layer (with a high nitrogen content corresponding to an estimated C/N-ratio of 0.05) followed by a 2.6 μm thick $TiC_{0.54}N_{0.46}$-layer, with columnar grains by using MTCVD-technique (temperature 850-885° C. and $CH_3CN$ as the carbon/nitrogen source). In subsequent steps during the same coating cycle, a 1.3 μm thick layer of $Al_2O_3$ was deposited using a temperature 970° C. and a concentration of $H_2S$ dopant of 0.4% as disclosed in U.S. Pat. No. 5,674,564. A thin (0.5 μl) layer of TiN was deposited on top according to known CVD-technique. XRD-measurement showed that the $Al_2O_3$-layer consisted of 100% κ-phase.

The coated inserts were brushed using a nylon straw brush containing SiC grains. Examination of the brushed inserts in a light optical microscope revealed that the outermost, thin TiN-layer and some of the $Al_2O_3$-layer had been brushed away along the very cutting edge, leaving there a smooth $Al_2O_3$-surface. Coating thickness measurements on cross sectioned, brushed inserts showed that the outermost TiN-layer and roughly half the $Al_2O_3$-layer had been removed along the edge line.

EXAMPLE 2

Inserts according to the present invention were tested in a face milling of cylinder heads in alloyed grey cast iron Tool: Sandvik Coromant R260.31-250

Number of inserts: 40 PCs

Criterion: Surface finish and work piece frittering.

Reference: TNEF 1204AN-CA in grade Sandvik Coromant K20W

Cutting Data

Cutting speed: Vc=118 m/min

Feed per tooth: Fz=0.23 mm per tooth

Depth of cut: Ap=3 mm

Wet Conditions

Tool life reference (prior art) 523 cylinder heads std. production

Tool life of invention 1027 cylinder heads. Average of 5 tests.

Increase of tool life 96% with improved surface finish and productivity.

EXAMPLE 3

Inserts according to the present invention were tested in a face milling of cylinder heads in alloyed grey cast iron Tool: Sandvik Coromant R260.31-250

Number of inserts: 40 PCs

Criteria: Surface finish and work piece frittering.

Reference TNEF 1204AN-65 in grade Sandvik Coromant K20W

Cutting Data

Cutting speed: Vc=156 m/min

Feed per tooth: Fz=0.29 mm per tooth

Depth of cut: Ap=3.5 mm

Wet Conditions

Tool life of reference (prior art) 683 cylinder heads in standard production.

Tool life of invention 1435 cylinder heads. Average of 5 tests

Increase of tool life 110% with improved surface finish.

EXAMPLE 4

Face milling of cylinder block in alloyed grey cast iron

Tool: Sandvik Coromant R260.31-315

Number of inserts: 50 PCs

Criteria: Work piece frittering.

Reference: TNEF 1204AN-CA in grade Sandvik Coromant GC4040

Cutting Data

Cutting speed: Vc=180 m/min

Feed per tooth: Fz=0.15 mm per tooth

Depth of cut: Ap=4 mm

Wet Conditions

Tool life reference 784 engine blocks std. production

Tool life of invention 1583 engine blocks. Average of five tests

Increase of tool life 100% with improved surface finish

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A cutting tool insert comprising a cemented carbide body and a coating wherein said cemented carbide body comprising WC with an average grain size of from about 1 to about 2.5 μm, from about 5 to about 8 wt-% Co and less than about 0.5 wt % cubic carbides of the metals Ta, Ti and/or Nb and a highly W-alloyed binder phase with a CW-ratio of 0.75-0.93 with less than about 1 vol-% eta-phase, and said coating comprising a first, innermost layer of $TiC_xN_yO_z$ with x+y+z=1,y>x and z less tan about 0.2 with equiaxed grains with size less than about 0.5 μm and a total thickness of from about 0.1 to about 1.5 μm, a layer of $TiC_xN_y$ with x+y=1, x greater than about 0.3 and y greater than about 0.3 with a thickness of from about 2 to about 3 μm with columnar grains with an average diameter of less than about 5 μm, a layer of a smooth, fine-grained, from about 0.5 to about 2 μm average grain size κ-$Al_2O_3$ with a thickness of from about 1 to about 2.5 μm, an outer layer of TiN with a thickness of from about 0.5 to about 1.0 μm, wherein the radius of the uncoated cutting edge is from about 35 to about 60 μm.

2. The cutting insert according to claim 1 wherein the amount of Co on the surface of said body is within about −2 wt % to about +4 wt % of the nominal Co-content.

3. The cutting insert of claim 1 wherein the outermost TiN-layer is removed along the cutting edge.

4. The cutting tool insert of claim 1 wherein said cemented carbide body comprises from about 5 to about 7 wt-% Co, in said first innermost layer, y is greater than about 0.8 and z=0, and in said $TiC_xN_y$ layer, x is greater than about 0.5.

5. The cutting tool insert of claim 1 wherein the radius of the uncoated cutting edge is from about 45 to about 55 μm.

6. The cutting insert according to claim 1 wherein the cemented carbide body comprises about 5 to about 7 wt-% Co.

7. The cutting insert according to claim 1 wherein the wherein the cemented carbide body comprises 0 wt-% cubic carbides.

8. The cutting insert according to claim 1 wherein The CW-ratio is 0.8 to 0.9.

9. The cutting insert according to claim 1 wherein the total thickness of the first, innermost layer is greater than about 0.1 μm.

10. The cutting insert according to claim 1 wherein the average diameter of the columnar grains is about 0.1 to about 2 μm.

11. The cutting insert according to claim 1 wherein the thickness of the layer of κ-$Al_2O_3$ is about 1.2 to about 1.7 μm.

12. The cutting insert according to claim 1 wherein the layer of κ-$Al_2O_3$ contains less than 5 vol-% of other phases.

13. The cutting insert according to claim 12 wherein the other phases include one or more of θ-$Al_2O_3$ and α-$Al_2O_3$.

14. The cutting insert according to claim 1 wherein the outer layer of TiN has a surface roughness $R_{max} \leqq 0.4$ mm over a length of 10 μm at least on an active part of a cutting edge.

15. The use of a cutting tool insert of claim 1 for wet milling, using fluid coolant of alloyed grey east iron with or without cast skin, at from about 110 to about 270m/min and a feed of from about 0.15 to about 0.35 mm/tooth or of compacted graphite iron and nodular iron with or without cast skin at a cutting speed of from about 70 to about 230 m/min and a feed of from about 0.15 to about 0.35 mm/tooth.

16. Method of making a milling insert comprising a cemented carbide body and a coating, said cemented carbide body comprising WC with an average grain size of from about 1 to about 2.5 μm, to from about 5 to about 8 wt-% Co and less than about 0.5 wt % cubic carbides of the metals Ta, Ti and/or Nb and a highly W-alloyed binder phase with a CW-ratio of 0.75-0.93 with <1 vol-% eta-phase the method comprising the steps of:

depositing by a CVD-method a first, innermost layer of $TiC_xN_yO_z$ with x+y+z=1, y>x and z less than about 0.2 having an equiaxed grain structure with a size less than about 0.5μm and a total thickness of from about 0.1 to about 1.5 μm, depositing by a MTCVD-technique a layer of $TiC_xN_y$ with x+y=1, x greater than about 0.3 and y greater than about 0.3 with a thickness of from about 1 to about 4 μm having a columnar grain structure with an average diameter of less than about 5 μm, wherein the MTCVD-technique uses acetonitrile as a source of carbon and nitrogen for forming a layer in a temperature range of from about 700 to about 900° C., depositing a layer of a smooth κ-$Al_2O_3$ with a thickness of from about 1 to about 2.5 μm and depositing an outer layer of TiN with a thickness of from about 0.5 to about 1.0 μm.

17. The method of claim 16 wherein the amount of Co on the surface is within about −2 wt % to about +4 wt % of the nominal Co-content.

18. The method of claim 16 further comprising removing the outermost TiN-layer along the cutting edge.

19. The method of claim 16 providing the uncoated cutting edge with a radius to from about 35 to about 65 μm, preferably from about 45 to about 55 μm.

20. The method of claim 19 further providing the uncoated cutting edge with a radius of from about 45 to about 55 μm.

* * * * *